US010281868B2

(12) United States Patent
Hamaba

(10) Patent No.: US 10,281,868 B2
(45) Date of Patent: May 7, 2019

(54) IMAGE FORMING APPARATUS AND METHOD FOR ESTABLISHING A SPECIFIED ANGULAR RELATIONSHIP BETWEEN A FIRST HOUSING AND A SECOND HOUSING

(71) Applicant: FUJI XEROX CO., LTD., Tokyo (JP)

(72) Inventor: Keijiro Hamaba, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/903,439

(22) Filed: Feb. 23, 2018

(65) Prior Publication Data

US 2018/0275600 A1 Sep. 27, 2018

(30) Foreign Application Priority Data

Mar. 22, 2017 (JP) ..... 2017-055657

(51) Int. Cl.
*G03G 21/16* (2006.01)
*G03G 15/00* (2006.01)

(52) U.S. Cl.
CPC ..... *G03G 21/1619* (2013.01); *G03G 21/1647* (2013.01); *G03G 21/1695* (2013.01); *G03G 15/6517* (2013.01); *G03G 2215/00455* (2013.01); *G03G 2221/1654* (2013.01)

(58) Field of Classification Search
CPC ..... G03G 15/6517; G03G 2215/00455; G03G 21/1647; G03G 21/1642; G03G 2221/1651; G03G 2221/1654; G03G 21/1619; G03G 21/1695
See application file for complete search history.

(56) References Cited

U.S. PATENT DOCUMENTS

2005/0244186 A1* 11/2005 Rose ..... G03G 21/1647 399/107

FOREIGN PATENT DOCUMENTS

JP 57197562 A * 12/1982 ..... G03G 15/6573
JP 2016-110037 A 6/2016

* cited by examiner

*Primary Examiner* — David M. Gray
*Assistant Examiner* — Laura Roth
(74) *Attorney, Agent, or Firm* — Sughrue Mion, PLLC

(57) ABSTRACT

An image forming apparatus includes a first housing that houses a first processing portion and a second housing that houses a second processing portion configured to receive a medium transported from the first processing portion. The image forming apparatus further includes a connecting member that connects the first housing and the second housing to each other such that a specified angular relationship may be established between the first processing portion and the second processing portion by orienting the first housing and the second housing in different directions.

8 Claims, 11 Drawing Sheets

| TYPE OF PAPER (TYPE OF MEDIUM) | DISTANCE BETWEEN ROLLER SHAFTS | AMOUNT OF CAM ADJUSTMENT |
|---|---|---|
| ROLLED PAPER | UP TO *.*** m | + *.* mm |
| | *.*** m TO *.*** m | + *.* mm |
| | *.*** m TO *.*** m | + *.* mm |
| | *.*** m TO *.*** m | − *.* mm |
| | OVER *.*** m | − *.* mm |
| CUT PAPER | UP TO *.*** m | + *.* mm |
| | *.*** m TO *.*** m | + *.* mm |
| | *.*** m TO *.*** m | + *.* mm |
| | *.*** m TO *.*** m | − *.* mm |
| | OVER *.*** m | − *.* mm |

IMAGE FORMING APPARATUS AND METHOD FOR ESTABLISHING A SPECIFIED ANGULAR RELATIONSHIP BETWEEN A FIRST HOUSING AND A SECOND HOUSING

CROSS-REFERENCE TO RELATED APPLICATIONS

This application is based on and claims priority under 35 USC 119 from Japanese Patent Application No. 2017-055657 filed Mar. 22, 2017.

BACKGROUND

(i) Technical Field

The present invention relates to an image forming apparatus and a method of adjusting the same.

(ii) Related Art

A hitherto known image forming apparatus includes plural processing units that are separate from one another. The processing units of such an image forming apparatus each include a housing that forms a skeleton or a frame, and a processing portion provided in the housing. The processing portion performs transfer, fixing, or the like. Typically, the housing is an enclosure formed of members such as panels. In such an image forming apparatus, adjacent ones of the processing units are connected to each other. Specifically, adjacent ones of the housings are connected to each other with bolts or the like. The orientation of each of the housings (the direction in which the front face of the housing faces, or the front-rear direction of the housing) thus connected to each other is fixed. The image forming apparatus forms an image on a medium such as paper. Known examples of the medium include continuous paper (also called continuous form paper or rolled paper) and cut paper.

SUMMARY

According to an aspect of the invention, there is provided an image forming apparatus that includes a first processing unit including a first processing portion that processes a medium, and a first housing that houses the first processing portion; a second processing unit including a second processing portion that receives the medium transported from the first processing portion, and a second housing that houses the second processing portion; and a connecting member that connects the first housing and the second housing to each other such that a specified angular relationship is established between the first processing portion and the second processing portion by orienting the first housing and the second housing in different directions.

BRIEF DESCRIPTION OF THE DRAWINGS

Exemplary embodiments of the present invention will be described in detail based on the following figures, wherein.

DETAILED DESCRIPTION

Figure 1:
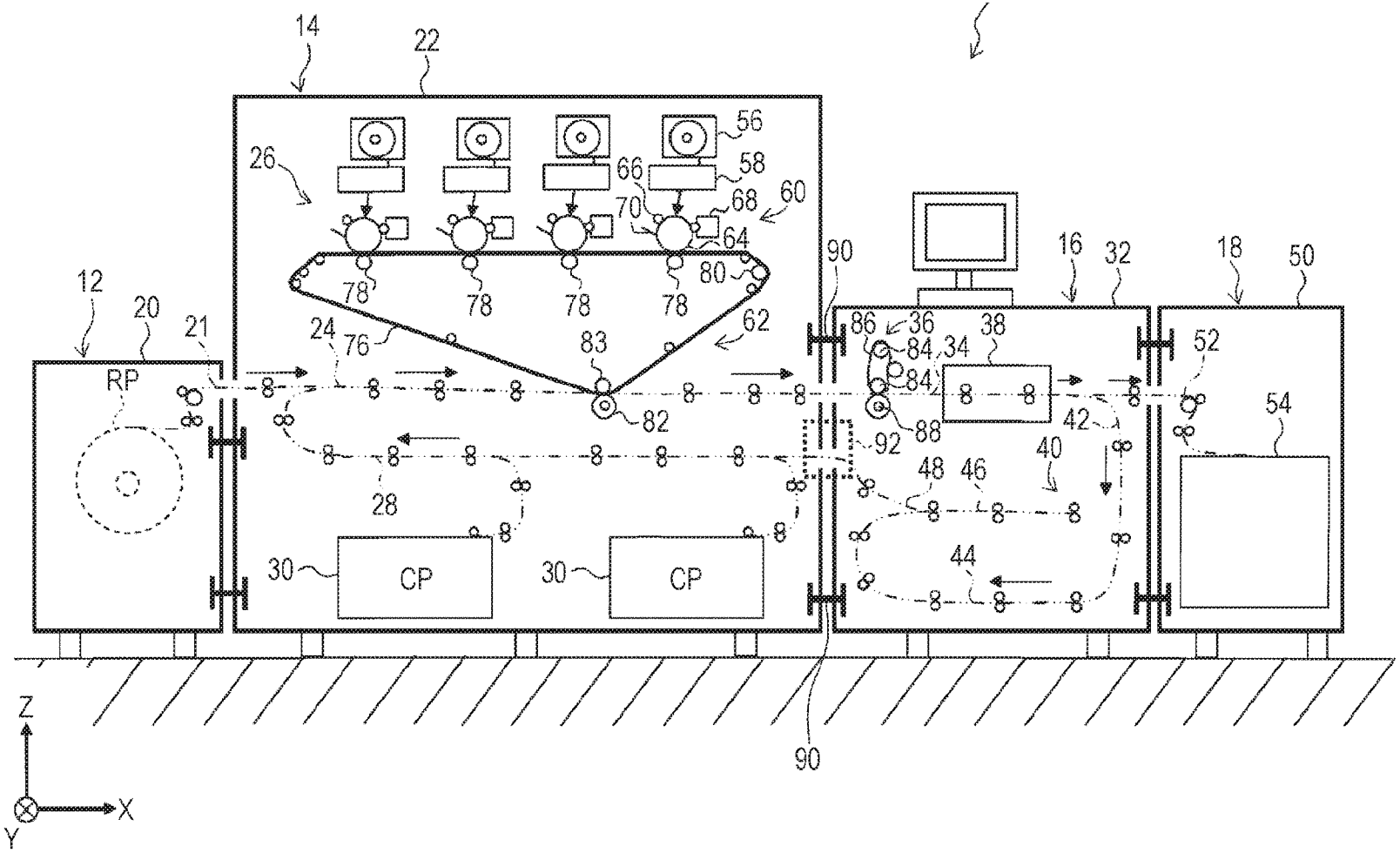
FIG. 1 is a schematic diagram of an image forming apparatus according to a first exemplary embodiment of the present invention.

FIG. 1 is a schematic diagram of an image forming apparatus 10 according to a first exemplary embodiment. In FIG. 1, the horizontal direction, the depthwise direction (the front-rear direction), and the vertical direction of the image forming apparatus 10 are defined as the X direction, the Y direction, and the Z direction, respectively, which also applies to the other drawings.

The image forming apparatus 10 includes a rolled-paper-container unit 12 that contains rolled paper RP, an imaging unit 14 that forms a toner image on the rolled paper RP or cut paper CP (the rolled paper RP and the cut paper CP are hereinafter collectively referred to as recording paper P (or a medium)), a fixing unit 16 that fixes the toner image on the recording paper P supplied thereto from the imaging unit 14, and a paper collecting unit 18 in which the recording paper P received from the fixing unit 16 is collected. Here, let each of elements of the image forming apparatus 10 that are not continuous with one another and are physically independent of one another be defined as a processing unit, and each of portions of the processing unit that directly act on the medium (typically, portions that process the medium and contribute to the transport of the medium) be defined as a processing portion. In the first exemplary embodiment, the imaging unit 14 and the fixing unit 16 each correspond to the processing unit. An image forming section 26 (in particular, a second transfer section), to be described below, provided in the imaging unit 14 and a fixing device 36, to be described below, provided in the fixing unit 16 each correspond to the processing portion. Other elements (such as the paper collecting unit 18) included in the apparatus may also be regarded as the processing units, and other portions exerting respective functions may also be regarded as the processing portions.

The rolled-paper-container unit 12 includes a housing 20, the rolled paper RP contained in the housing 20, and a transport path 21 along which the rolled paper RP is transported toward the imaging unit 14. The term "housing" refers to a skeleton (a frame). Typically, the housing is provided with walls (panels). Alternatively, an exemplary embodiment in which such walls serve as part of the housing that forms the skeleton may be employed, of course.

The imaging unit 14 includes a housing (a first housing) 22, a first transport path 24, the image forming section 26, a second transport path 28, and two cut-paper containers 30. The housing 22 forms the housing of the imaging unit 14. The first transport path 24 is connected at one end thereof to the transport path 21 of the rolled-paper-container unit 12, and at the other end thereof to a third transport path 34, to be described below, of the fixing unit 16. The first transport path 24 is provided for transporting the recording paper P from a side thereof facing the rolled-paper-container unit 12 toward a side thereof facing the fixing unit 16 (from left to right in FIG. 1). The image forming section 26 is provided above the first transport path 24 and forms a toner image on the recording paper P that is transported along the first transport path 24. The second transport path 28 is provided below the first transport path 24. The second transport path 28 is connected at one end thereof to a position of the first transport path 24 near the rolled-paper-container unit 12 (a position on the left side in FIG. 1) and at the other end thereof to a connecting path 48 of a reversing device 40, to be described below, included in the fixing unit 16. The two cut-paper containers 30 are provided below the second transport path 28. The two cut-paper containers 30 contain pieces of cut paper CP that are of different sizes or types, respectively. Each piece of cut paper CP is fed from a corresponding one of the cut-paper containers 30 into the second transport path 28, is transported along the second transport path 28 toward the side facing the rolled-paper-container unit 12 (the left side in FIG. 1), and is then fed into the first transport path 24.

The fixing unit 16 includes a housing (a second housing) 32, the third transport path 34, the fixing device 36, a cooling device 38, and the reversing device 40. The housing 32 forms the housing of the fixing unit 16. The third transport path 34 is connected at one end thereof to the first transport path 24 provided in the imaging unit 14 and at the other end thereof to a branch path 42 of the reversing device 40 and to a transport path of the paper collecting unit 18. The fixing device 36 is provided at an upstream position of the third transport path 34. The fixing device 36 fixes, with heat and pressure, the toner image formed on the recording paper P by the imaging unit 14. The cooling device 38 is provided on the downstream side of the fixing device 36. The cooling device 38 cools the recording paper P heated by the fixing device 36. The reversing device 40 is provided below the fixing device 36 and the cooling device 38. The reversing device 40 is used in duplex printing performed on the cut paper CP. The reversing device 40 includes the branch path 42 connected to the third transport path 34, a paper transport path 44 along which the cut paper CP transported thereto from the branch path 42 is transported toward a side facing the imaging unit 14, a reversing path 46 along which the cut paper CP transported thereto from the paper transport path 44 is switched backward and is thus turned over, and the connecting path 48 that connects the reversing path 46 to the second transport path 28 of the imaging unit 14. In such a configuration, the cut paper CP that is switched backward in the reversing path 46 returns to the imaging unit 14 and is transported along the second transport path 28 and the first transport path 24, whereby another toner image is formed on the back side of the cut paper CP by the image forming section 26.

The paper collecting unit 18 includes a housing 50, a transport path 52, and a collecting box 54. The transport path 52 connects the third transport path 34 of the fixing unit 16 to the collecting box 54, thereby allowing the recording paper P transported from the fixing unit 16 is collected in the collecting box 54.

To form an image on the rolled paper RP in the above configuration, the rolled paper RP is transported from the rolled-paper-container unit 12 into the imaging unit 14 and runs along the first transport path 24, whereby a toner image is formed on the rolled paper RP by the image forming section 26. The rolled paper RP is further transported into the fixing unit 16 and along the third transport path 34, whereby the toner image on the rolled paper RP is fixed by the fixing device 36. Then, the rolled paper RP is transported into the paper collecting unit 18. In the image forming operation performed on the rolled paper RP, the rolled paper RP extends over the imaging unit 14 and the fixing unit 16, and the image forming section 26 and the fixing device 36 perform the respective processing operations on the rolled paper RP simultaneously. In the image forming operation performed on the cut paper CP, the cut paper CP is transported along the second transport path 28 and then the first transport path 24, whereby a toner image is formed on the cut paper CP by the image forming section 26. The cut paper CP is further transported into the fixing unit 16 and along the third transport path 34, whereby the toner image on the cut paper CP is fixed by the fixing device 36. The cut paper CP is then transported into the paper collecting unit 18. Alternatively, the cut paper CP is turned over by the reversing device 40, undergoes the above process again, and is transported into the paper collecting unit 18.

Now, the image forming section 26 provided in the imaging unit 14 will be described in detail. The image forming section 26 includes toner cartridges 56, exposure units 58, image forming units 60, and a transfer device 62. The toner cartridges 56, the exposure units 58, and the image forming units 60 are provided for individual colors of yellow (Y), magenta (M), cyan (C), and black (K).

The exposure units 58 apply exposure light beams generated for the respective colors to the surfaces of respective photoconductors 64, to be described below, thereby forming electrostatic latent images on the photoconductors 64. The image forming units 60 include the photoconductors 64, respectively. The photoconductors 64, which rotate when driven, are each surrounded by the following elements: a charging device 66 that charges the photoconductor 64 by, for example, corona discharge (a non-contact charging method); a developing device 68 that develops the electrostatic latent image, which is formed on the photoconductor 64 charged by the charging device 66 and exposed to the exposure light applied thereto from a corresponding one of the exposure units 58, into a toner image by using a toner having a corresponding one of the colors; and a cleaning blade 70 that cleans the surface of the photoconductor 64 that has undergone a transfer process. The developing device 68 includes a developer container that contains a developer including the toner, and a developing roller that moves the toner in the developer container to the surface of the photoconductor 64. The developer container is supplied with the toner from a corresponding one of the toner cartridges 56.

The transfer device 62 is provided below the image forming units 60. The transfer device 62 includes an intermediate transfer belt 76 that is in contact with the photoconductors 64, four first-transfer rollers 78 that are provided on the inner side of the intermediate transfer belt 76 and transfer the toner images formed on the respective photoconductors 64 to the intermediate transfer belt 76 such that the toner images are superposed one on top of another, a driving roller 80 that is driven by a motor (not illustrated), a second-transfer roller 82 that transfers the superposed toner images from the intermediate transfer belt 76 to the recording paper P, and a supporting roller 83 that is provided across the intermediate transfer belt 76 from the second-transfer roller 82.

The intermediate transfer belt 76 is an endless member and is stretched around the four first-transfer rollers 78, the driving roller 80, the supporting roller 83, and plural other rollers. The intermediate transfer belt 76 rotates with the rotation of the driving roller 80. The first-transfer rollers 78 are provided across the intermediate transfer belt 76 from the respective photoconductors 64 of the image forming units 60, so that the toner images formed on the photoconductors 64 are first-transferred to the intermediate transfer belt 76. The second-transfer roller 82 presses the recording paper P against the intermediate transfer belt 76, thereby the toner images are transferred to the recording paper P. Specifically, the toner images in the respective colors that have been superposed one on top of another on the intermediate transfer belt 76 are second-transferred by the second-transfer roller 82 to the recording paper P transported along the first transport path 24. Thus, a toner image is formed on the recording paper P.

Now, the fixing device 36 provided in the fixing unit 16 will be described in detail. The fixing device 36 includes upper and lower heating rollers 84 both provided above the third transport path 34 and each including a heater serving as a heat source, a fixing belt 86 stretched between the two heating rollers 84, and a pressing roller 88 provided below the third transport path 34 and that presses the recording paper P against the lower heating roller 84. With the heating by the heating rollers 84 and the pressing by the pressing roller 88, the toner images are melted and are fixed to the recording paper P.

In the image forming apparatus 10 according to the first exemplary embodiment, the housing (the first housing) 22 of the imaging unit 14 (a first processing unit) and the housing (the second housing) 32 of the fixing unit 16 (a second processing unit) are connected to each other with a connecting mechanism (a connecting member). The connecting mechanism includes connectors 90, an inter-housing-distance adjuster 92 provided on the front side of the image forming apparatus 10, and a rotating-shaft mechanism 94 (not illustrated in FIG. 1) provided on the rear side of the image forming apparatus 10. In the first exemplary embodiment, the inter-housing-distance adjuster 92 is positioned at a height that is substantially half the height of the second housing 32. The rotating-shaft mechanism 94 (not illustrated in FIG. 1) is positioned at substantially the same height as the inter-housing-distance adjuster 92 and is on the rear side. In the image forming apparatus 10 according to the first exemplary embodiment, a combination of the inter-housing-distance adjuster 92 and the rotating-shaft mechanism 94 serves as an angle-changing mechanism 93 (not illustrated in FIG. 1) that is capable of adjusting the relative angle of one of the first housing 22 and the second housing 32 with respect to the other. Note that the connecting mechanism may also be provided between the housing 20 of the rolled-paper-container unit 12 and the housing (the first housing) 22 of the imaging unit 14 and between the housing (the second housing) 32 of the fixing unit 16 and the housing 50 of the paper collecting unit 18. Now, the angle-changing mechanism 93 will now be described in detail.

Figure 2:
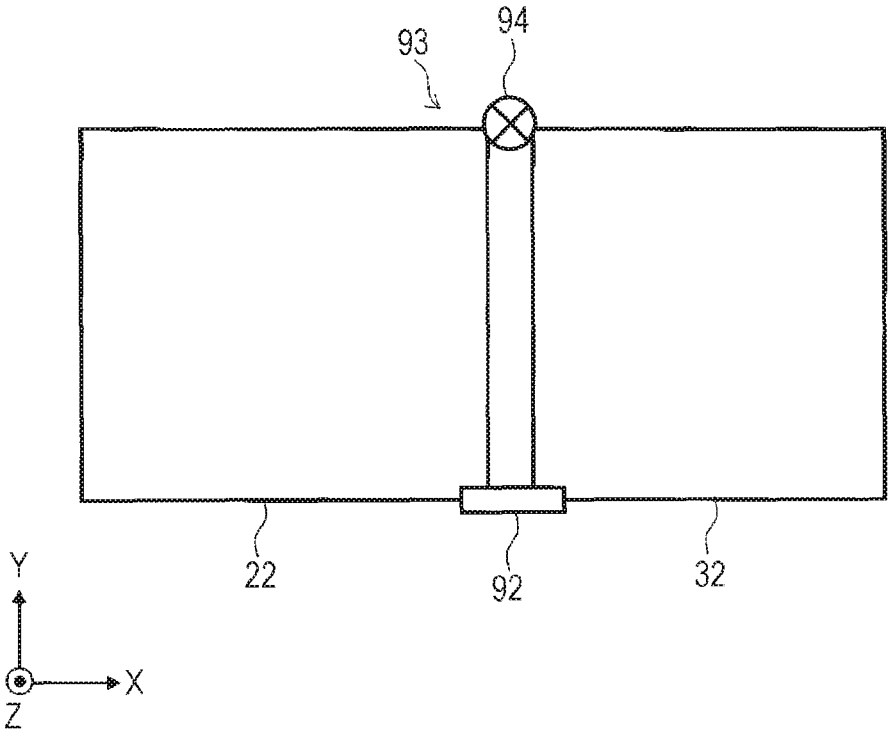
FIG. 2 illustrates an outline of an angle-changing mechanism according to the first exemplary embodiment of the present invention.

FIG. 2 is a diagram for illustrating the function of the angle-changing mechanism 93 according to the first exemplary embodiment and is a top view of the first housing 22 and the second housing 32. As illustrated in FIG. 2, the image forming apparatus 10 is provided with the inter-housing-distance adjuster 92 on the front side thereof and the rotating-shaft mechanism 94 on the rear side thereof. The combination of the inter-housing-distance adjuster 92 and the rotating-shaft mechanism 94 serves as the angle-changing mechanism 93. The inter-housing-distance adjuster 92 is capable of changing (adjusting) the distance between the first housing 22 and the second housing 32 (the distance in the X direction in FIG. 2) on the front side. The rotating-shaft mechanism 94 extends over the first housing 22 and the second housing 32 and allows one of the first housing 22 and the second housing 32 to rotate relative to the other about a rotating shaft included in the rotating-shaft mechanism 94. Thus, the distance between the first housing 22 and the second housing 32 on the front side is adjusted by using the inter-housing-distance adjuster 92, whereby the relative angle between the first housing 22 and the second housing 32 is adjusted.

Figure 3:
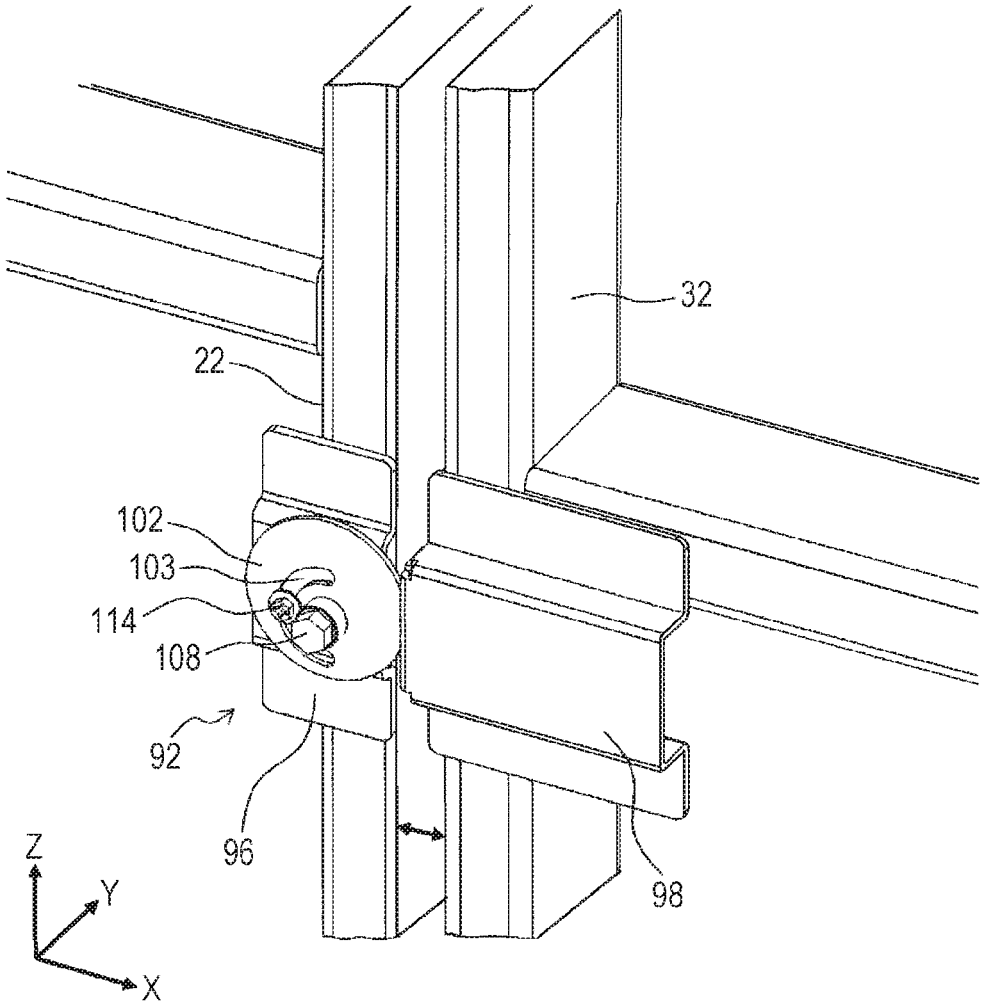
FIG. 3 is a perspective view of an inter-housing-distance adjuster according to the first exemplary embodiment of the present invention.
Figure 4:
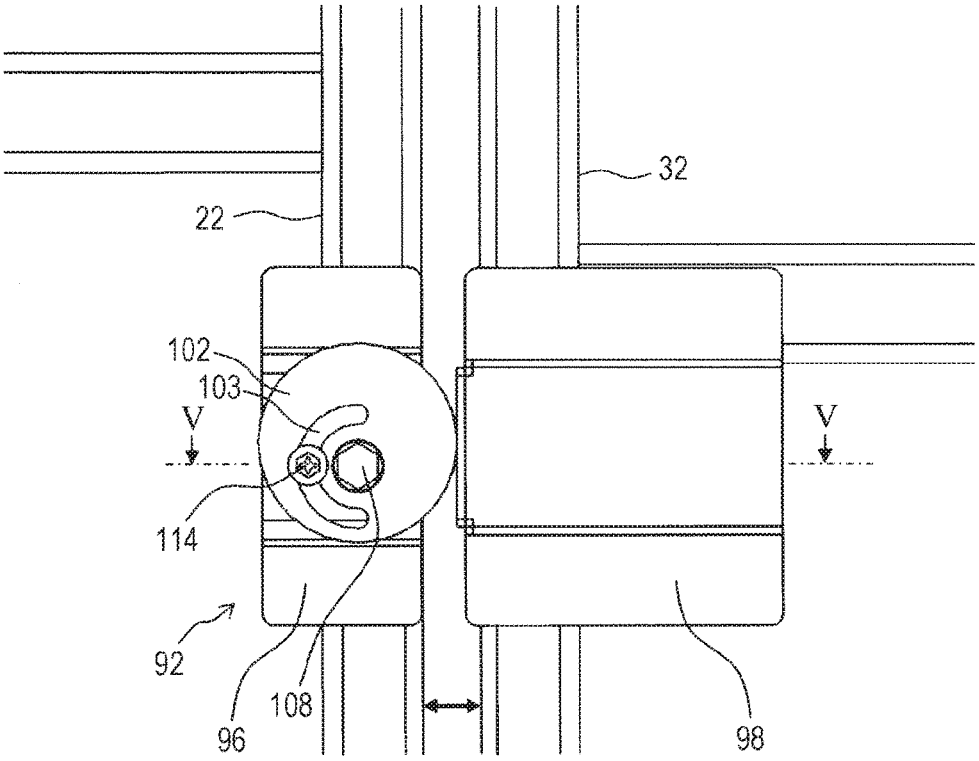
FIG. 4 is a front view of the inter-housing-distance adjuster according to the first exemplary embodiment of the present invention.

FIG. 3 is a perspective view of the inter-housing-distance adjuster 92 according to the first exemplary embodiment. FIG. 4 is a front view of the inter-housing-distance adjuster 92 according to the first exemplary embodiment. The inter-housing-distance adjuster 92 includes a first fixed member 96 fixed to the first housing 22, a second fixed member 98 fixed to the second housing 32, and an eccentric cam plate 102 rotatably held by the first fixed member 96. The eccentric cam plate 102 is provided with a bolt 108 fixed at a position shifted from the center of the eccentric cam plate 102. The outer peripheral edge of the eccentric cam plate 102 is in contact with an end of the second fixed member 98 that faces the first housing 22. When the eccentric cam plate 102 is rotated about the bolt 108, the length of projection of the eccentric cam plate 102 toward the second fixed member 98 changes. Thus, the eccentric cam plate 102 pushes the second fixed member 98, and the distance between the first housing 22 and the second housing 32 changes. That is, the eccentric cam plate 102 serves as a spacer member that determines the spacer length corresponding to the inter-housing distance. With the eccentric cam plate 102, the inter-housing distance is easily adjustable. That is, the ease of adjustment work is increased. Furthermore, since the spacer length is continuously changeable by rotating the eccentric cam plate 102, the inter-housing distance is finely adjustable. The eccentric cam plate 102 has a C-shaped hole 103, in which a screw 114 is fitted. After the distance between the first housing 22 and the second housing 32 is adjusted by rotating the eccentric cam plate 102, the screw 114 is fastened so that the eccentric cam plate 102 is fixed. If the eccentric cam plate 102 is rotated such that the outer peripheral edge thereof moves away from the second fixed member 98, one of the first housing 22 and the second housing 32 is pulled toward the other such that the distance between the first housing 22 and the second housing 32 becomes equal to the amount of adjustment with (i.e., the amount of projection of) the eccentric cam plate 102. Therefore, the outer peripheral edge comes into contact with the end of the second fixed member 98.

As illustrated in FIGS. 3 and 4, the inter-housing-distance adjuster 92 is provided on the front side of the image forming apparatus 10. That is, the inter-housing-distance adjuster 92 is provided at a position that is accessible by the user from the front side of the image forming apparatus 10. Hence, the user is allowed to perform the adjustment work very easily. If, for example, it is possible to provide a working space of a satisfactory size on the rear side of the image forming apparatus 10, the inter-housing-distance adjuster 92 may be provided on the rear side of the image forming apparatus 10, with the rotating-shaft mechanism 94 provided on the front side of the image forming apparatus 10.

Figure 5:
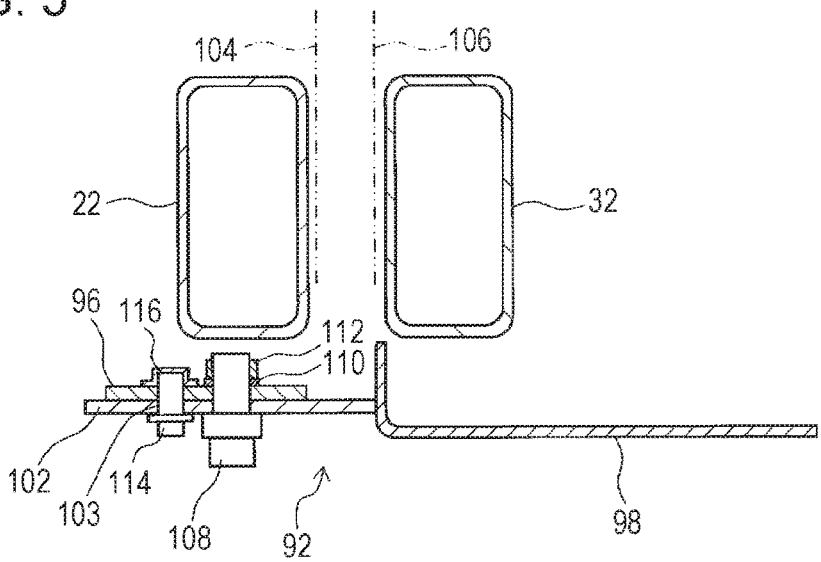
FIG. 5 is a sectional view of the inter-housing-distance adjuster according to the first exemplary embodiment of the present invention.

FIG. 5 is a sectional view (taken along line V-V illustrated in FIG. 4) of the inter-housing-distance adjuster 92 according to the first exemplary embodiment. In FIG. 5, the position of a wall (panel) 104 forming the imaging unit 14 and the position of a wall (panel) 106 forming the fixing unit 16 are represented by two-dot chain lines, respectively. The bolt 108 fitted in the eccentric cam plate 102 extends in a direction from the eccentric cam plate 102 toward the first housing 22. The first fixed member 96 has a hole for allowing the bolt 108 to extend therethrough. Thus, the bolt 108 extends through the first fixed member 96. The bolt 108 is fixed by a nut 112 provided on the back side of the first fixed member 96 with a spacer 110 interposed therebetween, whereby the eccentric cam plate 102 is rotatably held by the first fixed member 96. The screw 114 that fixes the eccentric cam plate 102 also extends in the direction from the eccentric cam plate 102 toward the first housing 22. The first fixed member 96 also has a hole for allowing the screw 114 to extend therethrough. Thus, the screw 114 extends through the first fixed member 96. The screw 114 is received by a screw receiving member 116 provided on the back side of the first fixed member 96.

Figure 6:
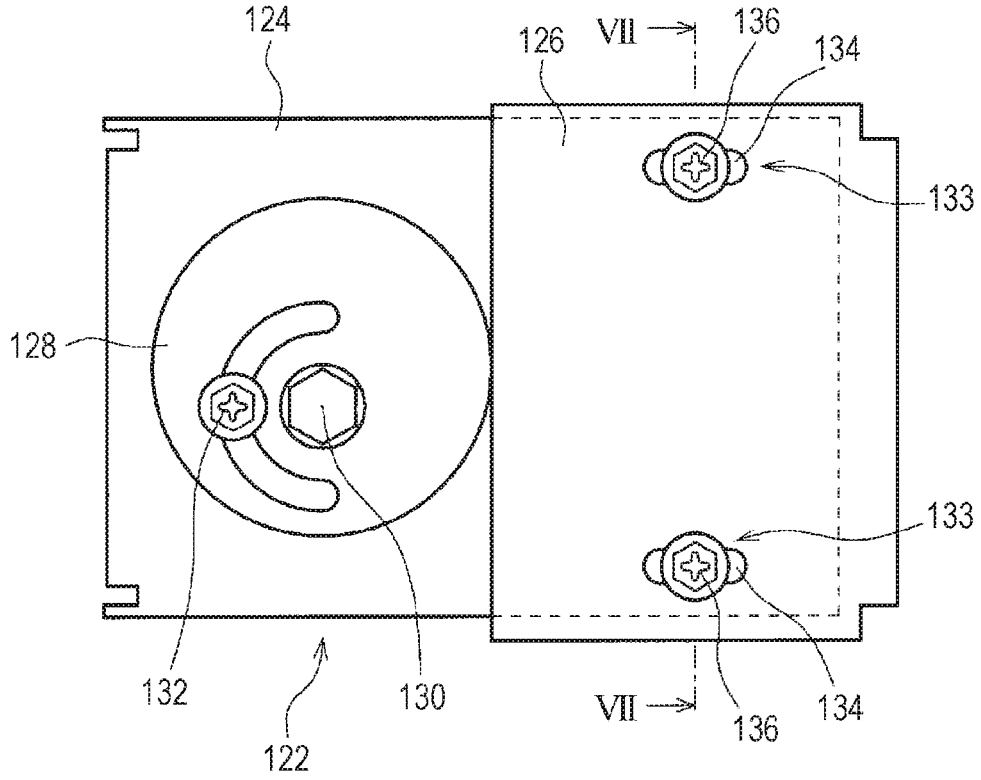
FIG. 6 is a front view of an inter-housing-distance adjuster according to a second exemplary embodiment of the present invention.
Figure 7:
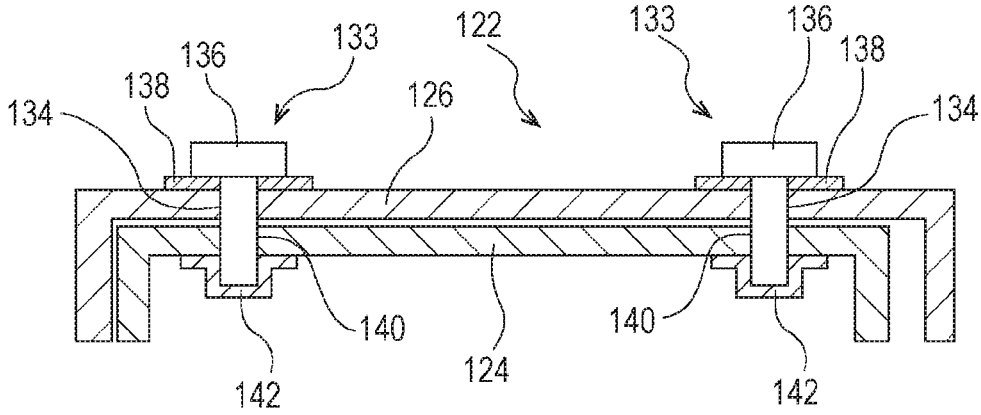
FIG. 7 is a sectional view of the inter-housing-distance adjuster according to the second exemplary embodiment of the present invention.

FIG. 6 is a front view of an inter-housing-distance adjuster 122 according to a second exemplary embodiment. FIG. 7 is a sectional view taken along line VII-VII illustrated in FIG. 6. The inter-housing-distance adjuster 122 illustrated in FIGS. 6 and 7 includes a locking mechanism 133 that locks the spacer length adjusted by an eccentric cam plate 128. Now, the inter-housing-distance adjuster 122 will be described.

As illustrated in FIG. 6, a first fixed member 124 that holds the eccentric cam plate 128 extends toward a second fixed member 126, and a substantially right half of the first fixed member 124 is positioned behind the second fixed member 126 and is not fixed to the first housing 22. As illustrated in FIG. 7, the first fixed member 124 and the second fixed member 126 each have a rectangular U shape. The first fixed member 124 is smaller than the second fixed member 126. Hence, the portion of the first fixed member 124 positioned behind the second fixed member 126 is nested inside the second fixed member 126. In FIG. 6, the outline of the portion of the first fixed member 124 that is nested inside the second fixed member 126 is represented by a broken line. In the inter-housing-distance adjuster 122 illustrated in FIGS. 6 and 7, as in the inter-housing-distance adjuster 92 described with reference to FIGS. 3 to 5, the outer peripheral edge of the eccentric cam plate 128 is in contact with the end of the second fixed member 126, and the second fixed member 126 is fixed to the second housing 32.

The second fixed member 126 has two oblong holes 134, into which screws 136 forming the locking mechanism 133 are fitted, respectively, with respective spacers 138 interposed therebetween. As illustrated in FIG. 7, the screws 136 are fitted in respective holes 140 provided in the first fixed member 124, and the screws 136 are received by respective screw receiving members 142 provided on the back side of the first fixed member 124.

To adjust the inter-housing distance, the two screws 136 forming the locking mechanism 133 are loosened, and a screw 132 that fixes the eccentric cam plate 128 is also loosened. Subsequently, the eccentric cam plate 128 is rotated by using a bolt 130, whereby the inter-housing distance is adjusted. That is, the inter-housing angle is adjusted. Subsequently, the two screws 136 forming the locking mechanism 133 are fastened so that the inter-housing distance is locked. Then, the screw 132 that fixes the eccentric cam plate 128 is fastened.

Since the inter-housing-distance adjuster 122 includes the locking mechanism 133, the inter-housing distance that is adjusted by the eccentric cam plate 128 is lockable. Hence, the inter-housing distance (the inter-housing angle) thus adjusted is prevented from changing accidentally. That is, the inter-housing angle is maintained.

Figure 8:
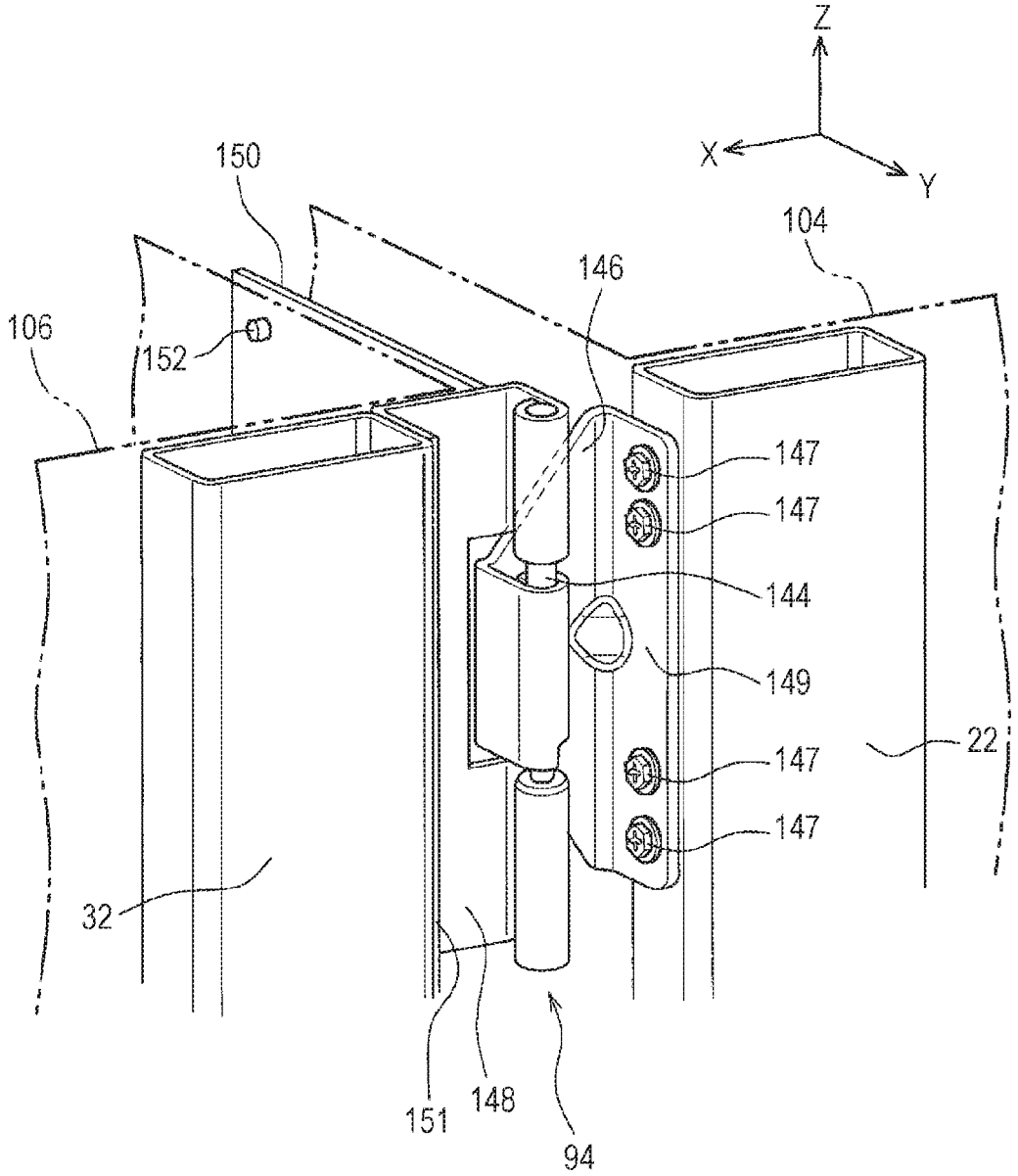
FIG. 8 is a perspective view of a rotating-shaft mechanism according to the first exemplary embodiment of the present invention.
Figure 9:
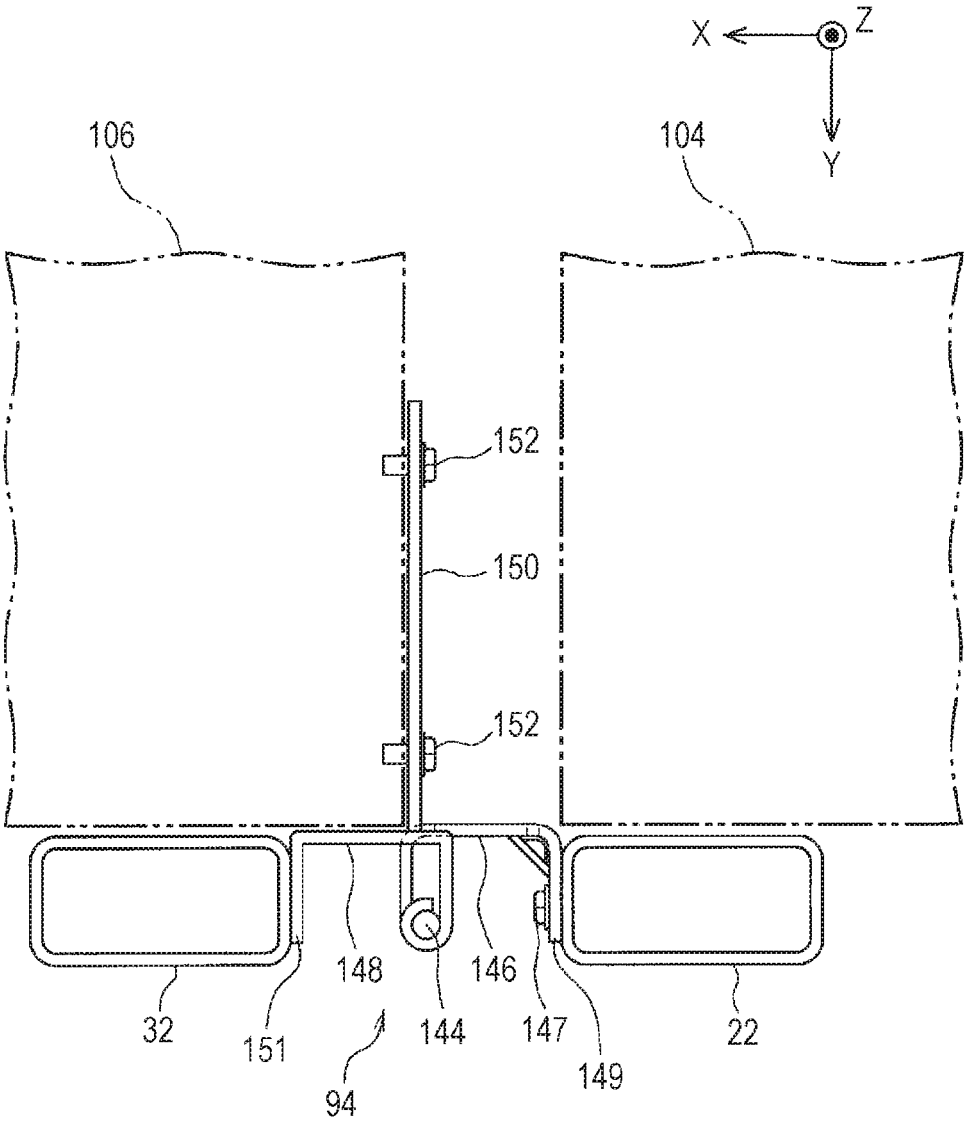
FIG. 9 is a top view of the rotating-shaft mechanism according to the first exemplary embodiment of the present invention.

Now, the rotating-shaft mechanism 94 will be described. FIG. 8 is a perspective view of the rotating-shaft mechanism 94 according to the first exemplary embodiment. In FIG. 8, portions of the first housing 22 and the second housing 32 that extend above the rotating-shaft mechanism 94 are not illustrated. FIG. 9 is a top view of the rotating-shaft mechanism 94 according to the first exemplary embodiment. The rotating-shaft mechanism 94 includes a rotating shaft 144, and a first attachment 146 and a second attachment 148 that are rotatably held by the rotating shaft 144. The first attachment 146 includes a flat portion 149 on a side thereof facing the first housing 22. The flat portion 149 is fixed to the first housing 22 with plural bolts 147. The second attachment 148 includes a flat attaching plate 150 extending toward the front side of the image forming apparatus 10 (the −Y side in FIGS. 8 and 9). The attaching plate 150 is fixed to the wall (panel) 106, which is held by the second housing 32, with plural bolts 152. The second attachment 148 further includes a flat portion 151 on a side thereof facing the second housing 32. The flat portion 151 is in contact with the second housing 32. Since the rotating-shaft mechanism 94 is provided over the first housing 22 and the second housing 32, one of the first housing 22 and the second housing 32 is allowed to rotate relative to the other housing about the rotating shaft 144.

Now, angle adjustment performed with the angle-changing mechanism 93 according to the first exemplary embodiment will be described with reference to FIGS. 10 to 13.

Figure 10:
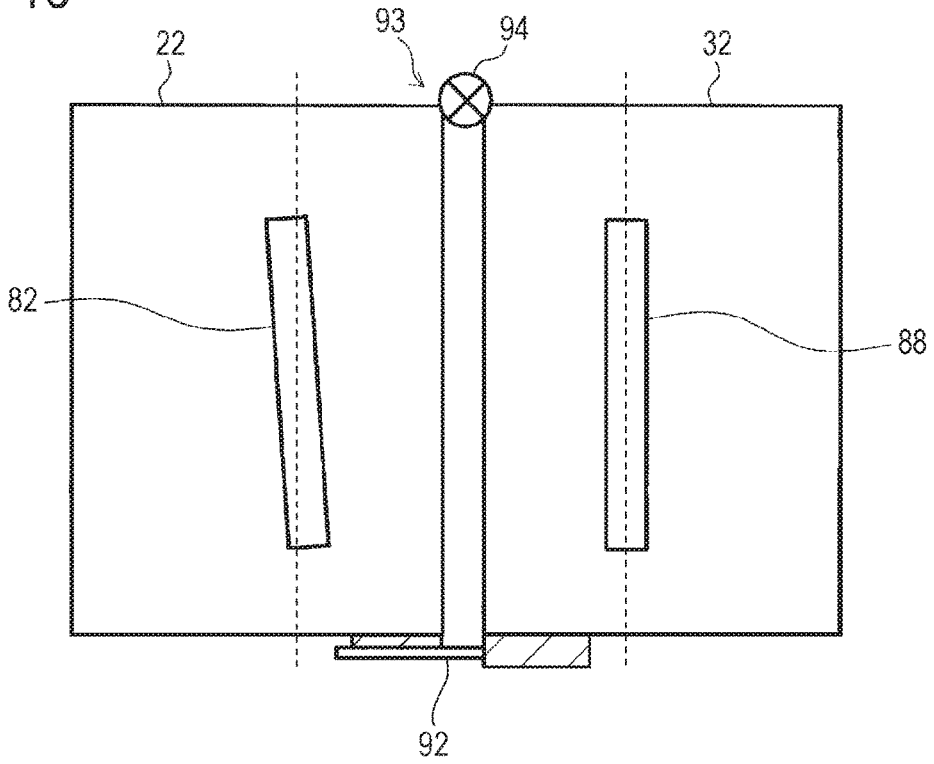
FIG. 10 illustrates an angle adjustment method performed by using an angle-changing mechanism according to the first exemplary embodiment of the present invention.
Figure 11:
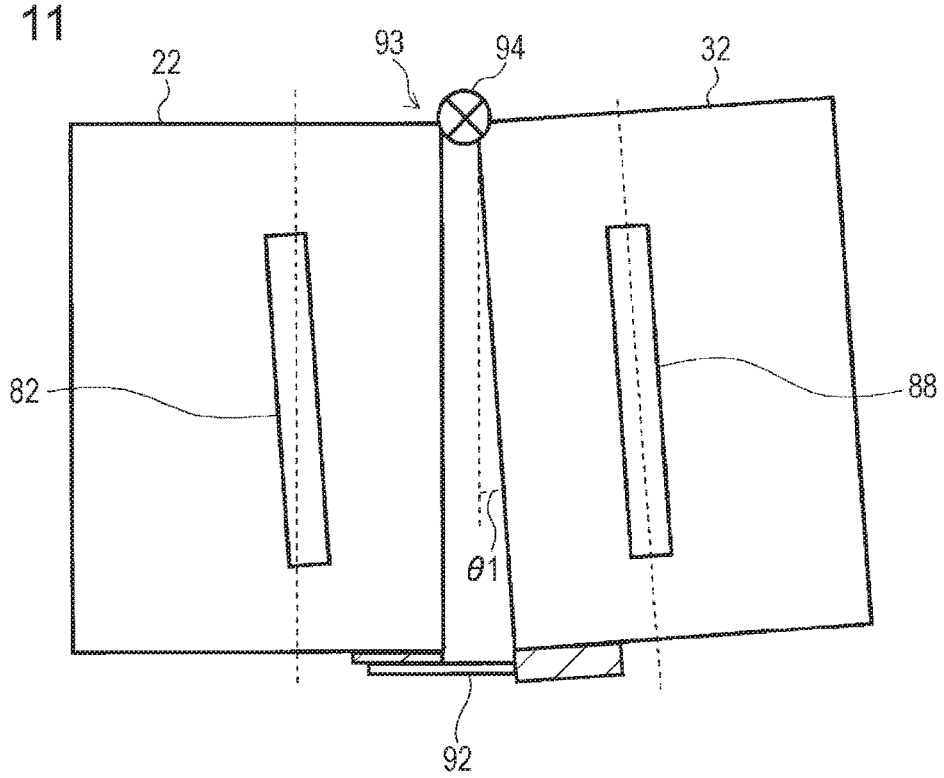
FIG. 11 also illustrates the angle adjustment method performed by using the angle-changing mechanism according to the first exemplary embodiment of the present invention.

FIG. 10 illustrates the second-transfer roller 82 included in the image forming section 26 (the first processing portion) provided in the first housing 22, and the pressing roller 88 included in the fixing device 36 (the second processing portion) provided in the second housing 32. In FIG. 10, the second-transfer roller 82 is tilted counterclockwise and is not parallel to the pressing roller 88. In such a case, in the image forming apparatus 10 according to the first exemplary embodiment, the second-transfer roller 82 and the pressing roller 88 are made parallel to each other or at a desired relative angle with respect to each other by using the combination of the inter-housing-distance adjuster 92 and the rotating-shaft mechanism 94 that serves as the angle-changing mechanism 93. FIG. 11 illustrates a state where the second-transfer roller 82 and the pressing roller 88 that are not parallel to each other in FIG. 10 are made parallel to each other by using the angle-changing mechanism 93. In FIG. 11, the distance between the first housing 22 and the second housing 32 on the front side is increased by using the inter-housing-distance adjuster 92, whereby the angle of the second housing 32 with respect to the first housing 22 is changed. Specifically, letting the inter-housing angle in the case where the first housing 22 and the second housing 32 are parallel to each other be 0 degrees or substantially 0 degrees, the inter-housing angle is changed by an angle θ1 toward the positive side. The inter-housing angle is an angle of rotation of one of the two housings relative to the other about the rotating shaft 144 of the rotating-shaft mechanism 94. As illustrated in FIG. 11, the second-transfer roller 82 and the pressing roller 88 are made parallel to each other by changing the inter-housing angle. Thus, the angular relationship specified between two processing portions is easily established with a natural rotational motion about a rotating shaft. Furthermore, the inter-housing angle is adjustable by adjusting the inter-housing distance, which is an easily identifiable index.

Figure 12:
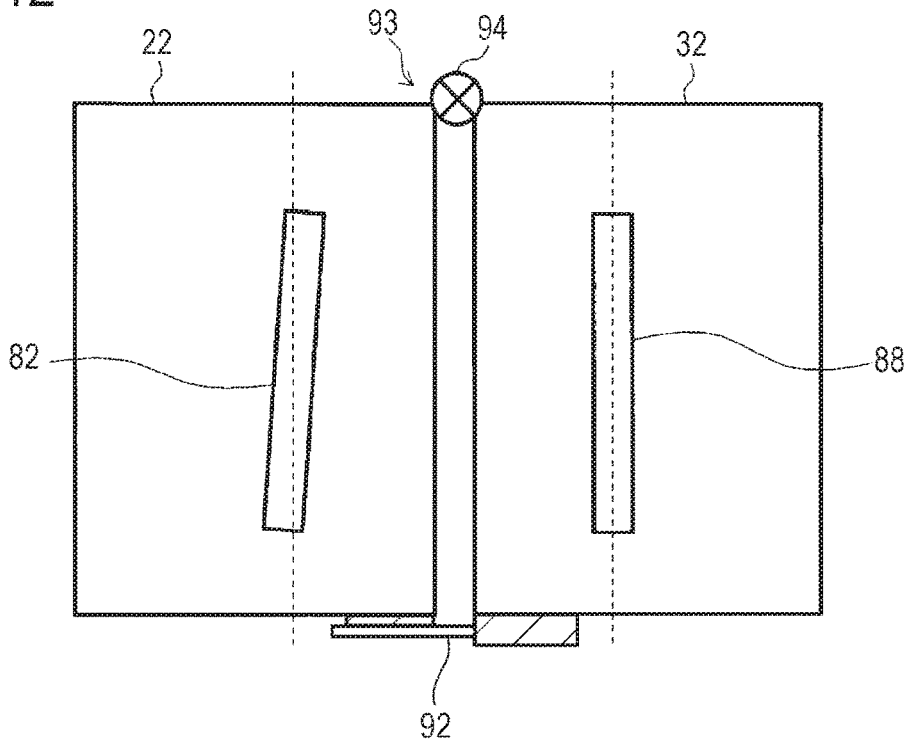
FIG. 12 also illustrates the angle adjustment method performed by using the angle-changing mechanism according to the first exemplary embodiment of the present invention.
Figure 13:
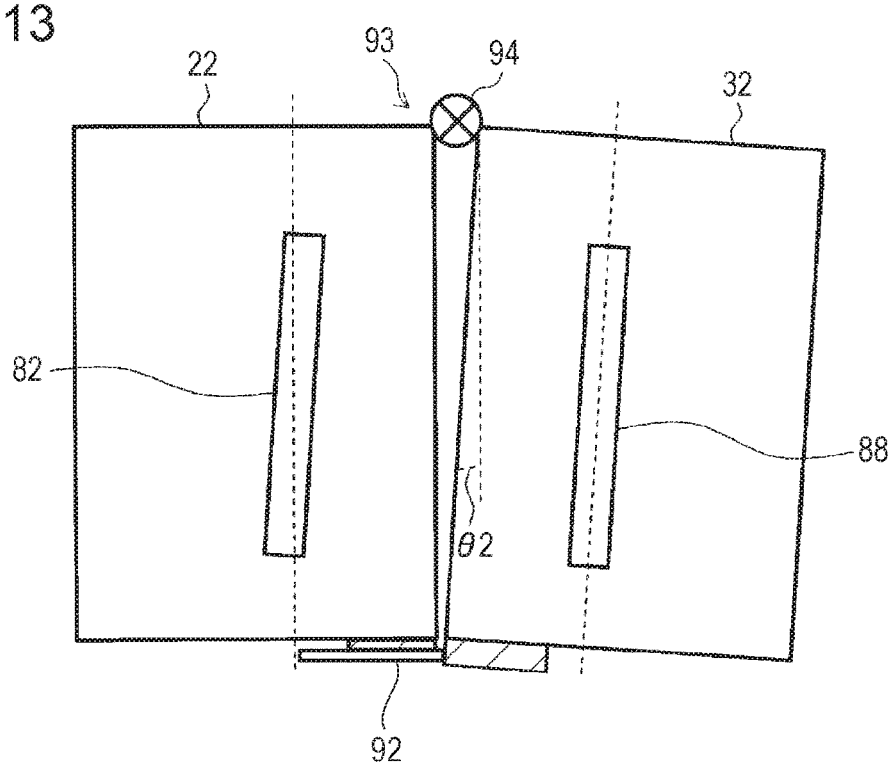
FIG. 13 also illustrates the angle adjustment method performed by using the angle-changing mechanism according to the first exemplary embodiment of the present invention.

FIG. 12 illustrates a state where the second-transfer roller 82 is tilted clockwise and is not parallel to the pressing roller 88. FIG. 13 illustrates a state where the second-transfer roller 82 and the pressing roller 88 that are not parallel to each other in FIG. 12 are made parallel to each other by using the inter-housing-distance adjuster 92. In FIG. 13, the distance between the first housing 22 and the second housing 32 on the front side is reduced by using the inter-housing-distance adjuster 92, whereby the angle of the second housing 32 with respect to the first housing 22 is changed. Specifically, letting the inter-housing angle in the case where the first housing 22 and the second housing 32 are parallel to each other be 0 degrees or substantially 0 degrees, the inter-housing angle is changed by an angle θ2 toward the negative side, whereby the second-transfer roller 82 and the pressing roller 88 become parallel to each other. Thus, the inter-housing angle is changeable toward both the positive side and the negative side. Hence, the inter-housing angle is changeable not only toward one side (the positive side) but also toward the other side (the negative side) in accordance with a desired angular relationship.

In FIGS. 10 and 12, the angle is adjusted such that the second-transfer roller 82 (the first processing portion) and the pressing roller 88 (the second processing portion) become parallel to each other. However, the angle adjustment is not limited to such a method. Depending on the type of the medium or the like, the angle may be adjusted such that the first processing portion and the second processing portion do not become parallel to each other.

The image forming apparatus 10 according to the first exemplary embodiment that has been described above is configured such that the first housing 22 and the second housing 32 are orientable in different directions by using the connecting member, i.e., the combination of the inter-housing-distance adjuster 92 and the rotating-shaft mechanism 94, that connects the first housing 22 and the second housing 32. Hence, a specified angular relationship between the first processing portion provided in the first housing and the second processing portion provided in the second housing is established without adjusting the angles of the processing portions individually in the respective housings. Since an appropriate angular relationship is established between the first processing portion of the first housing and the second processing portion of the second housing, the occurrence of a defect such as the meandering of the medium during transport, the wrinkling of the medium, or the stretching on one side of the medium is suppressed effectively.

Figure 14:
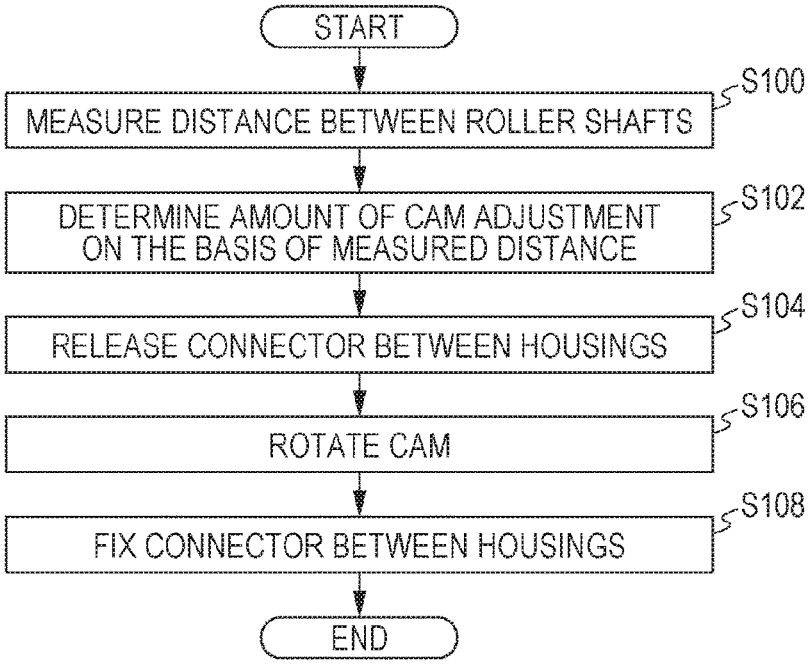
FIG. 14 is a flow chart illustrating an angle adjustment process according to the first exemplary embodiment of the present invention.

Now, an exemplary method of adjusting the angle of the image forming apparatus will be described. FIG. 14 is a flow chart illustrating an angle adjustment process. The process illustrated in FIG. 14 is performed when, for example, the type of the medium (the type of the recording paper P such as the rolled paper RP, the cut paper CP, or the like) that is to undergo image formation is changed.

Referring to FIG. 14, in step S100, the angular error between a first reference shaft of the first processing portion provided in the first housing and a second reference shaft of the second processing portion provided in the second housing is measured. In the first exemplary embodiment, the angular error between the second-transfer roller 82 (the first reference shaft) of the image forming section 26 (the first processing portion) provided in the imaging unit 14 (the first processing unit) and the pressing roller 88 (the second reference shaft) of the fixing device 36 (the second processing portion) provided in the fixing unit 16 (the second processing unit) is measured. Specifically, the distance between two roller shafts is measured, whereby the angular error is measured.

Figure 15:
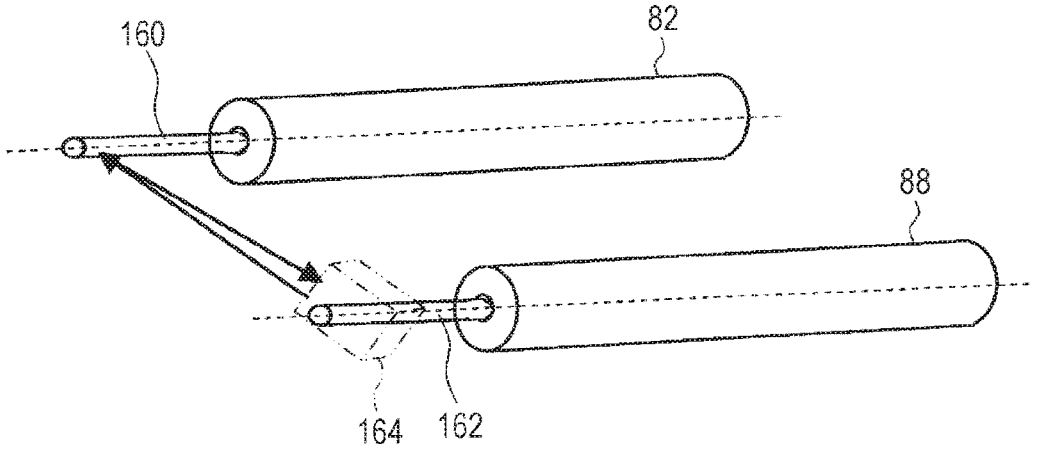
FIG. 15 is a schematic diagram illustrating a method of measuring the distance between roller shafts according to the first exemplary embodiment of the present invention.

FIG. 15 is a schematic diagram illustrating a method of measuring the distance between two roller shafts. To measure the distance between the two roller shafts, a door provided on the front side of the image forming apparatus is opened first, and extended members 160 and 162 housed in the centers of the respective rollers are pulled out toward the front side. Subsequently, a roller-shaft-distance detector 164 is attached to one of the two extended members 160 and 162. The roller-shaft-distance detector 164 detects the distance by using, for example, a light emitting element and a light receiving element. In the roller-shaft-distance detector 164, light is emitted from the light emitting element provided on one of the extended members 160 and 162 toward the other, and the light reflected by the other extended member is received by the light receiving element, whereby the distance between the extended members 160 and 162 (the distance between the roller shafts) is detected. The distance between the roller shafts may be measured in another method, as long as the distance between the roller shafts is measurable by that method.

Referring to FIG. 14 again, in step S102, the angle between the first housing and the second housing is determined on the basis of the measured angular error (the distance between the roller shafts). Specifically, the amount of adjustment by using the eccentric cam plate is determined on the basis of the distance between the roller shafts that is represented as the angular error. For example, a table such as the one illustrated in FIG. 16 that summarizes the type of paper (the type of the medium) and the amount of cam adjustment corresponding to the distance between the roller shafts is prepared in advance, and the amount of cam adjustment that corresponds to the type of the medium to be used and the measured distance between the roller shafts is found with reference to the table.

Referring to FIG. 14 again, in step S104, the connectors 90 that connect the first housing and the second housing to each other are released. Subsequently, in step S106, the inter-housing angle between the first housing and the second housing is adjusted. Specifically, the eccentric cam plate 102 is rotated by the amount of cam adjustment that is determined in step S102. Then, in step S108, the connectors 90 that connect the first housing and the second housing to each other are fastened.

According to the above adjustment method, the inter-housing angle is adjustable on the basis of an objective index, which is the distance between the roller shafts, or the angular error. Furthermore, since the process illustrated in FIG. 14 is performed when the type of the medium (the type of the recording paper P such as the rolled paper RP, the cut paper CP, or the like) that is to undergo an image forming process is changed, an angular relationship that is suitable for the medium to be used is established between the processing portions. If the type of the medium is changed, the required angular relationship between the processing portions may also change. Therefore, the amount of adjustment is changed with the type of the medium, as described above. Thus, an angular relationship that is suitable for the medium to be used is established between the processing portions. Consequently, the occurrence of a defect such as the meandering of the medium during transport is effectively suppressed. While the rolled paper and the cut paper are named as the type of medium in the table illustrated in FIG. 16, any other types of medium may be named additionally, of course. If the rolled paper and the cut paper are each categorized into plural types, the amount of adjustment may be changed with those types of medium.

Figures 16, 17:
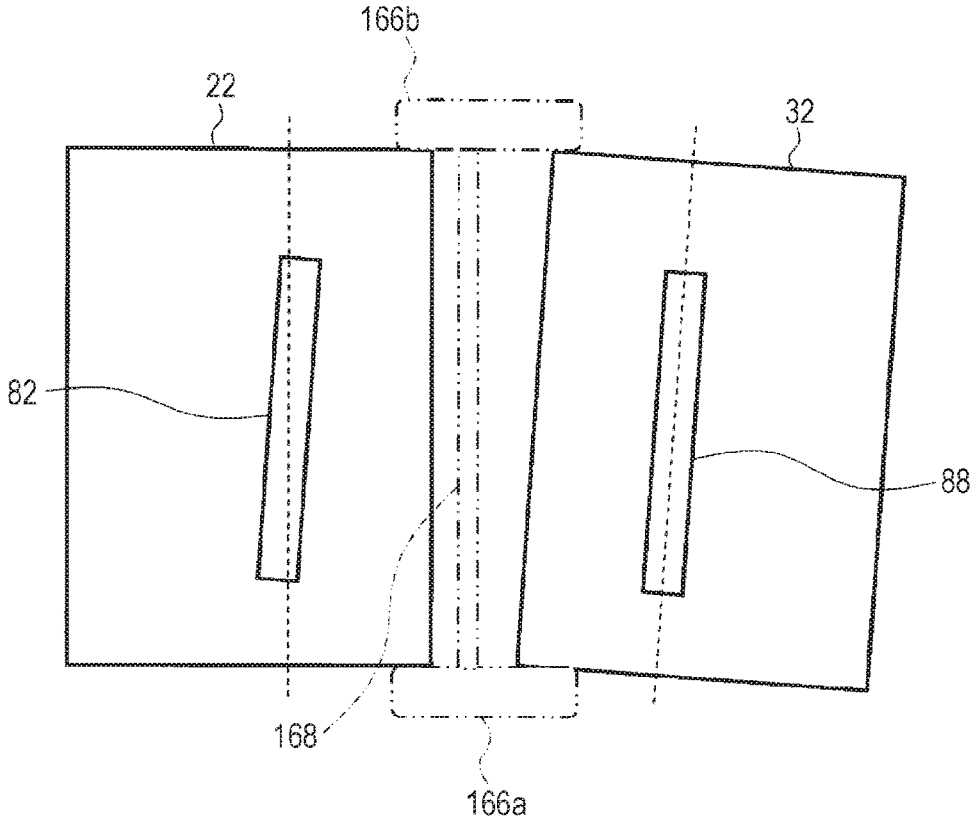
FIG. 16 is a table summarizing the distance between the roller shafts and the amount of cam adjustment according to the first exemplary embodiment of the present invention.
FIG. 17 illustrates a configuration according to a third exemplary embodiment of the present invention that includes two inter-housing-distance adjusters.

Now, a configuration according to a third exemplary embodiment that includes two inter-housing-distance adjusters will be described. FIG. 17 illustrates a configuration according to the third exemplary embodiment that includes two inter-housing-distance adjusters. As illustrated in FIG. 17, a front-side inter-housing-distance adjuster 166*a* and a rear-side inter-housing-distance adjuster 166*b* are provided between the first housing 22 and the second housing 32 on the front side and the rear side, respectively. A combination of the front-side inter-housing-distance adjuster 166*a* and the rear-side inter-housing-distance adjuster 166*b* is regarded as the inter-housing-distance-adjusting mechanism. The front-side inter-housing-distance adjuster 166*a* adjusts the distance between the first housing 22 and the second housing 32 on the front side. The rear-side inter-housing-distance adjuster 166*b* adjusts the distance between the first housing 22 and the second housing 32 on the rear side. The front-side inter-housing-distance adjuster 166*a* and the rear-side inter-housing-distance adjuster 166*b* are connected to each other with an interlocking member 168. The interlocking member 168 is, for example, a belt, a shaft, or the like. The interlocking member 168 transmits the amount of adjustment made by the front-side inter-housing-distance adjuster 166*a* to the rear-side inter-housing-distance adjuster 166*b*. That is, the rear-side inter-housing-distance adjuster 166*b* itself is not operated for adjustment but is operated by operating the front-side inter-housing-distance adjuster 166*a*. Thus, the user does not need to move to the rear side of the image forming apparatus so as to perform adjustment work by using the rear-side inter-housing-distance adjuster 166*b*. Of course, the rear-side inter-housing-distance adjuster 166*b* itself may be operated for adjustment. The angle between the first housing 22 and the second housing 32 is determined by the amount of adjustment by using the front-side inter-housing-distance adjuster 166*a* and the rear-side inter-housing-distance adjuster 166*b*.

The above configuration of adjusting the inter-housing angle may be employed in which the rotating-shaft mechanism provided on the rear side is replaced with the rear-side inter-housing-distance adjuster 166*b* so that the inter-housing distance is adjustable at two positions on the front and rear side, respectively. In such a configuration, wider angle adjustment is realized than in the configuration including the rotating-shaft mechanism only on the rear side.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first processing unit including:

a first processing portion configured to process medium; and a first housing that houses the first processing portion;

a second processing unit including:

a second processing portion configured to receive the medium transported from the first processing portion; and a second housing that houses the second processing portion; and a connecting member configured to connect the first housing and the second housing to each other such that a specified angular relationship is established between the first processing portion and the second processing portion by orienting the first housing and the second housing in different directions, wherein, letting an inter-housing angle between the first housing and the second housing that are parallel to each other be substantially 0 degrees, the connecting member includes an angle-changing mechanism that is capable of changing the inter-housing angle both to a positive angle and to a negative angle, wherein the connecting member further includes a rotating-shaft mechanism that allows one of the first housing and the second housing to rotate relative to another of the first housing and the second housing about a rotating shaft, wherein the inter-housing angle is a relative angle of rotation of the another of the first housing and the second housing relative to the one of the first housing and the second housing about the rotating shaft, wherein the angle-changing mechanism includes an inter-housing-distance adjuster configured to adjust the relative angle of rotation about the rotating shaft by adjusting an inter-housing distance between the first housing and the second housing, and wherein the inter-housing-distance adjuster includes a spacer member provided to the one of the first housing and the second housing, and wherein the spacer member is configured to set a spacer length that determines the inter-housing distance by coming into contact with the another of the first housing and the second housing.

2. The image forming apparatus according to claim 1, wherein the spacer member comprises an eccentric cam plate, and wherein the image forming apparatus is configured so that the spacer length may be continuously changed by rotating the cam plate.

3. The image forming apparatus according to claim 2, wherein the inter-housing-distance adjuster includes a locking mechanism configured to lock the spacer length determined by the spacer member.

4. The image forming apparatus according to claim 1, wherein the inter-housing-distance adjuster includes a locking mechanism configured to lock the spacer length determined by the spacer member.

5. An image forming apparatus comprising:

a first processing unit including:

a first processing portion configured to process a medium; and a first housing that houses the first processing portion;

a second processing unit including:

a second processing portion configured to receive the medium transported from the first processing portion; and a second housing that houses the second processing portion; and a connecting member configured to connect the first housing and the second housing to each other such that a specified angular relationship is established between the first processing portion and the second processing portion by orienting the first housing and the second housing in different directions, wherein, letting an inter-housing angle between the first housing and the second housing that are parallel to each other be substantially 0 degrees, the connecting member includes an angle-changing mechanism that is capable of changing the inter-housing angle both to a positive angle and to a negative angle, wherein the connecting member includes an inter-housing-distance-adjusting mechanism configured to change the inter-housing angle by adjusting at least one of a front-side inter-housing distance between the first housing and the second housing at a front side of the image forming apparatus and a rear-side inter-housing distance between the first housing and the second housing at a rear side of the image forming apparatus, and wherein the inter-housing-distance-adjusting mechanism includes:

a front-side inter-housing-distance adjuster configured to adjust the front-side inter-housing distance; and a rear-side inter-housing-distance adjuster configured to adjust the rear-side inter-housing distance.

6. The image forming apparatus according to claim 5, wherein the front-side distance adjuster is provided at a position that is accessible by a user from a front side of the apparatus.

7. A method of adjusting an image forming apparatus, the method comprising:

measuring an angular error between a first reference shaft included in a first processing portion provided in a first housing and a second reference shaft included in a second processing portion provided in a second housing, the second processing portion being configured to receive a medium that is transported from the first processing portion;

adjusting an inter-housing angle between the first housing and the second housing using the measured angular error; and fastening the first housing and the second housing to each other after adjusting the inter-housing angle.

8. The method according to claim 7, wherein the medium is a continuous medium that is to be processed by the first processing portion and by the second processing portion simultaneously, and wherein the method is performed if a type of the medium is changed.

* * * * *